United States Patent [19]

Zion et al.

[11] Patent Number: 4,984,734

[45] Date of Patent: Jan. 15, 1991

[54] STACKABLE ARTICULATED CARTON TRAY APPARATUS

[75] Inventors: Kenneth J. Zion, New Lenox; Allan J. Tison, Kearney, Mo.

[73] Assignee: Stone Container Corporation, Chicago, Ill.

[21] Appl. No.: 414,922

[22] Filed: Sep. 29, 1989

[51] Int. Cl.[5] ..... B65D 5/20

[52] U.S. Cl. ..... 229/109; 229/125.01; 229/906; 229/918; 229/919; 229/DIG. 2; 229/DIG. 11

[58] Field of Search ..... 229/109, 110, 125.01, 229/902, 906, 915, 918, 919, DIG. 11, DIG. 2, DIG. 4; 206/509, 512

[56] References Cited

U.S. PATENT DOCUMENTS

| | | | |
|---|---|---|---|
| 1,771,760 | 7/1930 | MacLellan | 229/DIG. 4 |
| 1,794,125 | 2/1931 | Sugerman | 229/DIG. 4 |
| 2,083,623 | 6/1937 | Thorup | 229/109 |
| 2,625,315 | 1/1953 | Fehrenkamp | 229/DIG. 4 |
| 2,955,733 | 10/1960 | Wilson | 229/109 |
| 3,507,441 | 4/1970 | Wilcox et al. | 229/109 |
| 3,533,547 | 10/1970 | Houston | 229/DIG. 2 |
| 4,042,165 | 8/1977 | Elder | 229/DIG. 4 |
| 4,765,534 | 8/1988 | Zion et al. | 229/109 |

FOREIGN PATENT DOCUMENTS

| | | | |
|---|---|---|---|
| 3530350 | 8/1986 | Fed. Rep. of Germany | 229/919 |
| 1439175 | 4/1966 | France | 229/DIG. 11 |
| 2223988 | 10/1974 | France | 229/DIG. 11 |
| 2248980 | 5/1975 | France | 229/DIG. 11 |
| 541920 | 4/1956 | Italy | 229/DIG. 11 |
| 2116150 | 9/1980 | United Kingdom | 229/109 |
| 2043596 | 10/1980 | United Kingdom | 229/DIG. 11 |

*Primary Examiner*—Gary E. Elkins
*Attorney, Agent, or Firm*—Dick and Harris

[57] ABSTRACT

A stackable articulated carton tray apparatus for flat food products, particularly pizza pies, capable of being stacked in multiple quantities upon one another such that the bottom panel or an upper carton apparatus forms the cover for the adjacent lower carton apparatus. The carton apparatus is further joinable in a manner so as to prevent the shifting and separation of the stacked carton apparata during transport. The carton apparatus includes an octagonal bottom panel, side walls and detachable top panel for the uppermost one of several carton trays. Emanating from the side walls are alignment and interlock flaps for aligining and releasably joining multiple ones of the carton tray apparatus in a stacked configuration.

20 Claims, 3 Drawing Sheets

STACKABLE ARTICULATED CARTON TRAY APPARATUS

BACKGROUND OF THE INVENTION

The present invention relates generally to container products and specifically to a stackable articulated carton tray apparatus for flat food products, particularly pizza pies, capable of being stacked in multiple quantities upon one another such that the bottom panel of an upper carton apparatus forms the cover for the adjacent lower carton apparatus. The present invention is constructed so that multiple carton apparata may be joined to one another in a manner which prevents the shifting and separation of the stacked carton apparata during transport to thereby enable the packaging of multiple pizza pies without the expense and labor incurred in providing each pizza pie with its own complete wrapper.

It has long been popular for restaurants to make pizza pies available to the consumer for consumption outside of the restaurant environment by providing both a "carry-out" service where customers may pick up a pizza from the eating establishment and by providing delivery whereby pizza pies are brought directly to the consumer's home or office. In both instances it is desirable to package each individual pizza in a wrapper to protect it during transport and to retain its warmth. Such packaging typically varies from merely placing pizzas held on round cardboard circles into paper bags which are stapled closed, to the present popular use of cardboard cartons constructed to prevent crushing of the pizza, particularly when such cartons are stacked, and to better prevent heat loss while on route to the consumer.

A recent marketing trend in the carry-out/delivery pizza industry is to market and promote the sale of several pizza pies for a total price which may be less than would normally be charged for several individual pizzas. It is also increasingly common that the consumer often purchases more than one pizza at a time, as in urban office environments where multiple pizza pies may be ordered for delivery to the office for parties, overtime meals and the like. As a result, it is often necessary to package each pizza in its own complete wrapper nothwithstanding the fact that more than one pizza is being purchased by a customer.

One particular prior art container patented by the present assignee comprises an octagonal shaped container for pizza pies constructed as a shallow carton formed from a one-piece paperboard blank having an integral octagonal bottom, side walls and attached octagonal top as disclosed in U.S. Pat. No. 4,765,534. While the container disclosed therein, and as otherwise utilized by the food industry, serves its purpose well when used in connection with the provision of single pizzas, such prior art containers may be economically unefficient in instances where multiple pizza pies are purchased by a single customer. When providing multiple pizza pies it is still desirable that each be wrapped in a container which prevents crushing and heat loss and accordingly, it is necessary that each container have a bottom, sides and top—preferably through more economical means.

Unfortunately, the use of most prior art containers in such circumstances results in the duplication of packaging material with the added expense of providing complete containers for each pizza pie and the added instability of stacked unsecured cartons in the customer's automobile or the delivery vehicle.

Accordingly it is an object of the present invention to provide a stackable articulated carton apparatus for flat food products, particularly pizza pies, which is capable of being effectively stacked, with improved reinforcement against collapse, in multiple quantities upon one another, such that the bottom panel of an upper carton apparatus forms the cover for the adjacent lower carton apparatus thereby omitting the use of a separate cover and resultant additional material expense for the lower cartons.

It is an additional object of the present invention to provide a carton apparatus which may be joined in a multiple stacked configuration in a manner so as to prevent the shifting and separation of the stacked carton apparata during transport to or by the consumer.

It is another object of the present invention to provide such a carton tray apparatus which enables the packaging of multiple pizza pies without the expense and labor incurred in providing each pizza pie with its own complete wrapper.

It is yet a further object of the present invention to provide a carton tray apparatus which is hexagonal or octagonal in shape, among other shapes with at least one reinforced diagonal corner, preventing shifting of the pizza pie contained therewithin—while minimizing the amount of container material required by same.

It is still another object of the present invention to provide a carton tray apparatus constructed by articulation of a blank formed from a substantially continuous sheet of corrugated cardboard material providing for ease of manufacture, assembly, articulation, shipping and inventorying, while resulting in cost savings to the users of same.

A further object of the present invention is to provide a carton apparatus which utilizes a single detached cover panel for sealing the uppermost stacked carton apparatus thereby saving the expense of utilizing increasingly costly paperboard stock.

These and other objects of the invention will become apparent in light of the present specification and drawings.

SUMMARY OF THE INVENTION

The present invention comprises a stackable articulated carton tray apparatus for flat food products, particularly pizza pies, which apparatus is capable of being stacked in multiple quantities upon one another such that the bottom panel of an upper carton apparatus forms the cover for the adjacent lower carton apparatus. The stacked articulated carton tray apparata are further joinable in a manner so as to prevent the shifting and separation of the stacked carton apparatuses during transport, to thereby enable the packaging of multiple pizza pies without the additional material, expense and labor incurred in providing each pizza pie with its own complete container.

The articulated tray apparatus itself comprises a bottom panel means, a first pair of upstanding opposite first and second side wall means operably attached to and emanating upwardly from the bottom panel means, and a second pair of upstanding opposite third and fourth side wall means operably attached to and emanating upwardly from the bottom panel means. Further provided are tray locking means operably positioned on one or more of the respective upstanding first, second, third and fourth side wall means emanating upwardly from the bottom panel means, for maintaining the first, second, third and fourth side walls in a restrained articulated shape, in co-operation with the side walls themselves.

Forming substantially diagonal corner wall means upon articulation of the carton apparatus, are a plurality of corner panel means attached at opposite ends of one or more of the first and second pairs of side wall means, which include corner tab means operably attached thereto along substantially continuous corner tab fold edges therebetween. The corner tab means are restrainably interposed between adjacent respective ones of the first, second, third and fourth side wall means upon the articulation of the carton apparatus, by the tray locking means, towards formation and maintenance of a substantially rigid articulated hexagonal, octagonal or other geometrically shaped tray member having one or more diagonal corners.

For aligning and releasably joining multiple like ones of the carton tray apparatuses in stacked configuration stacking means are provided which emanate from one or more of the first, second, third and fourth side wall means. Further provided is a detachable cover panel means operably positionable upon the uppermost one of a plurality of like tray members, as a top closure to the food product positioned within the uppermost tray member.

In the preferred embodiment of the invention the plurality of corner panel means are operably attached at opposite ends of the first and second side wall means, with the corner panel means and respective associated corner tab means being restrainably interposed between respective adjacent ones of the third and fourth side wall means positioned between the first and second side wall means. Additionally, the tray locking means are operably positioned on each of the third and fourth side wall means for cooperation with these side walls to envelope and restrainably interpose the respective corner tabs therebetween.

In the preferred embodiment of the invention, the upstanding opposite first and second side wall means are operably attached for articulation to the bottom panel means along substantially continuous respective first and second side wall fold edges therebetween, while the upstanding opposite third and fourth side wall means are further operably attached for articulation to the bottom panel means along respective third and fourth side wall fold edges therebetween. The tray locking means comprises a locking flap member operably attached for articulation to the respective upstanding opposite third and fourth side wall means, along respective locking panel fold edges therebetween, for enveloping and restraining respective ones of adjacent interposed corner tab means and for, in turn, maintaining the first, second, third and fourth side wall means in positions substantially normal to the bottom panel means.

Each of the corner panel means, in this embodiment, includes a first corner flap portion and a second corner flap portion. The first corner flap portion is operably attached at opposite ends of both the first and second side wall means for deployment in an upwardly emanating position substantially normal to the bottom panel means, upon articulation of the carton tray apparatus, while each of the second corner flap portions is operably attached at a first side to a respective first corner flap portion, and, at a second side to an adjacent edge of the bottom panel means—for overlying juxtaposition thereto upon articulation of the carton tray apparatus. Through such a construction four substantially diagonal corner wall means are formed upon articulation of the carton tray apparatus.

The stackable articulated carton tray apparatus further provides for each of the first corner flap portions of the corner panel means to be connected to each of the respective second corner flap portions of the corner panel means, respectively, along a corner flap fold line for rotation therebetween upon articulation of the carton tray apparatus.

In the preferred embodiment, the stacking means which emanate from one or more of the first, second, third and fourth side wall means for aligning and releasably joining multiple ones of the carton tray apparatus in a stacked configuration, comprise one or more alignment flaps operably associated with the third and fourth side wall means, for telescopically receiving the bottom portion of a superimposed like tray member. The stacking means further include interlock means operably positioned within the alignment flaps for releasably attaching a portion of the stacking means of one tray member to the superimposed like tray member. The interlock means preferably comprises an interlock flap member in the stacking means together with a knock-out flap within a formed aperture in the superimposed like tray member, for the aligned telescopic receipt of the interlock flap member within the aperture formed by the knock-out flap to further prevent separation of stacked carton apparata from one another.

Locking panel fold edges are configured to be substantially discontinuous about an offset region between the tray locking means and the third and fourth side walls, to simultaneously form the stacking means upon articulation of the carton apparatus. The stacking means extend above the associated third and fourth side wall means respectively so as to abut and be juxtaposed to the third and fourth side wall means of a superimposed like tray member for the alignment and releasable joining of successive ones of the like tray members stacked thereupon. The knock-out flap means are preferably pre-formed into the third and fourth side wall means, and, as previously described, comprise substantially rectangular members capable of being displaced to create an aperture for accepting the receipt and interposition of the interlockflap member from the third and fourth side wall members of the tray member positioned below the stacked, successive like tray member.

The plurality of corner panel means in the preferred embodiment are attached to one or more of said first, second, third and fourth side wall means along a plurality of corner panel fold lines respectively, each such corner fold line being formed of a plurality of perforations positioned along said corner panel fold lines. As described, the second corner flap portion of each of said plurality of corner panel means is foldable onto the bottom panel means upon articulation of said carton apparatus towards formation of four substantially diagonal corner wall means.

Tray locking means emanate from their respectile side wall along locking means fold edges operably positioned between the locking means and the respective side wall. Preferably, each of the locking means fold edges comprise two substantially parallel fold lines to create a fold plate member with each fold line including a plurality of perforations formed therewithin whereby the two fold lines and fold plane member facilitate the encircling and enveloping and retention of the respective corner tab means the tray locking means, in cooperation with the respective side wall from which the locking panel extends.

As further described by the preferred embodiment, the detachable cover panel means is substantially octagonal in shape and of an overall dimension capable of covering all of the emanating edges of the first, second, third and fourth side wall means, together with the upstanding diagonal wall portion of corner wall means, to in turn, fully cover the food product within the uppermost tray member. Two opposing edges of the detachable cover means further include notches for receiving the stacking means in the uppermost tray member so as to releasably secure the cover panel means in place upon the uppermost tray member.

In one embodiment of the invention, the stacking means further includes reliance upon the interlock means emanating therefrom, for further releasably engaging and maintaining the detachable cover panel means in place atop the uppermost tray member.

In the preferred embodiment of the invention, in which the tray locking means are operably positioned on each of the third and fourth side wall means, and in which the third and fourth side wall means emanating respectively along third and fourth side wall fold edges, which side wall edges, are substantially discontinuous about an offset region therealong the respective third and fourth side wall means, so as to simultaneously form locking retention notches therein, upon articulation of the third and fourth side wall means about the third and fourth side wall fold edges. The tray locking means on each of the third and fourth side wall means include locking tab means which, upon articulation of the carton apparatus, are interposed into and restrainably received by a respective one of the locking retention notches. These structural means retain the tray locking means in a position about the corner tab means, which are operably enveloped, interposed and maintained within respective ones of the third and fourth side wall means and associated tray locking means, thereby forming the erect tray member.

In the preferred embodiment, at least one of the plurality of corner panel means includes a vent hole for venting from the interior of the carton tray apparatus, moist air generated by the contained food towards retaining the crispness of the food product.

Preferably, the first second, third and fourth side wall means emanate from the bottom panel means along first, second, third and fourth side wall fold edges respectively. The tray locking means emanate from one or more of the first, second, third and fourth side wall means along locking panel fold edges respectively and the first, second, third and fourth side wall fold edges, the locking panel fold edges, and the corner tab fold edges each include a plurality of perforations formed and scored therewithin.

The invention contemplates that the bottom panel means, the first and second side wall means, the third and fourth side wall means, the tray locking means, the plurality of corner panel means, and the corner tab means are all formed from a single substantially continuous sheet of apparatus material, which in the preferred embodiment comprises a single substantially continuous sheet of corrugated cardboard material.

DETAILED DESCRIPTION OF THE DRAWINGS

Figure 1:
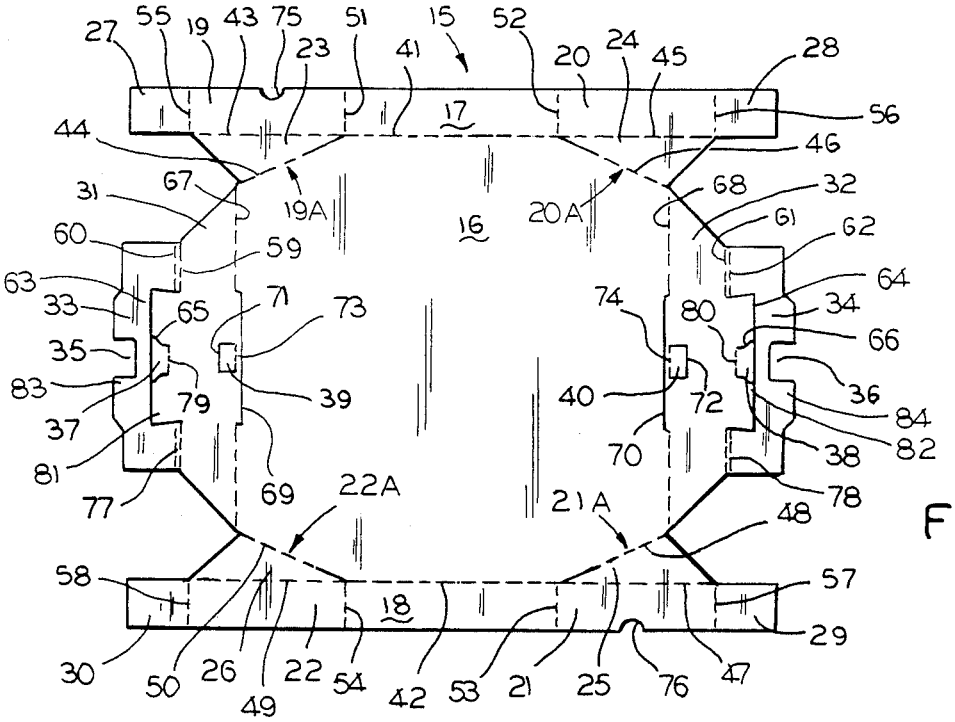
FIG. 1 of the drawings is a top plan view of the unarticulated carton blank for the present carton tray apparatus in which the bottom panel, side walls, locking panels, corner panels and corner tabs are shown together with respective fold edges therebetween.

While this invention is susceptible of embodiment in many different forms, there is shown in the drawings and will herein be described in detail one specific embodiment, with the understanding that the present invention disclosure is to be considered an exemplification of the principles of the invention and is not intended to limit the invention to the embodiment illustrated.

Stackable articulated carton apparatus 15 is shown in FIG. 1 as being formed from a container blank comprising a substantially continuous sheet of material, which, upon articulation, forms a shallow depth container or tray for containing and transporting flat food products, and in particular, pizza pies.

As will be described herein in detail, the carton apparatus 15 of the present invention, formed upon articulation of the container blank, may be stacked in multiple quantities, one on top of another, towards the containment of multiple pizza food products. Bottom panel 16 forms the bottom of carton apparatus 15. First and second side walls 17 and 18 are shown attached to bottom panel 16 along substantially continuous respective first and second side wall fold edges 41 and 42. Third and fourth side walls 31 and 32 are shown similarly attached to bottom panel 16 along respective third and fourth side wall fold edges 67 and 68.

Locking flap members 33 and 34 are shown attached to third and fourth side walls 31 and 32 respectively, along double locking panel fold edges 59–60 and 61–62. Attached at each end of first side wall 17 are corner panels 19A and 20A, and likewise shown attached to each end of second side wall 18 are corner panels 21A and 22A.

In a preferred embodiment as illustrated in FIG. 1, each corner panel includes first corner flap portions 19 through 22 and second corner flap portions 23 through 26, wherein each first corner flap portion is attached at opposite ends of the associated side wall along first corner flap portion fold edges 51 through 54. Each second corner flap portion is shown attached to the adjacent edges of bottom panel 16 along second corner flap portion fold edges 44, 46, 48 and 50. Upon articulation of the carton apparatus, the corner panels serve to form substantially diagonal corner walls as to create a hexagonal, octagonal or otherwise shaped container with diagonal corners, such shape serving to effectively retain a substantially round pizza food product.

The first corner flap portions 19 through 22 of corner panels 19A through 22A are shown connected to the second corner flap portions 23 through 26 along substantially continuous corner flap fold lines 43, 45, 47 and 49, respectively.

Corner tab means 27 through 30 are shown attached to the first corner flap portion 19 through 22 of corner panels 19A through 22A, respectively, along substantially continuous corner tab fold edges 55 through 58. Upon articulation and assembly of the carton apparatus 15, corner tabs 27 and 30 are interposed and retained between the third side wall 31 and locking flap member 33 whereas corner tabs 28 and 29 are interposed and retained between the fourth side wall 32 and its associated locking flap member 34. The juxtaposition of the locking flap members 33 and 34 to the respective third and fourth side walls 31 and 32, and in turn enveloping of the respective corner tabs, serves to form a substantially rigid octagonal container.

Locking flap member 33, in the preferred embodiment of the invention as illustrated herein, is shown attached to third side wall 31 along fold edges which comprise two substantially parallel locking panel fold lines formed by incisions 65 and 66, respectively about two sides of each member with perforations 79 and 80 serving to permit manual deflection while retaining knock-out flaps 39 and 40 and maintaining their connection to side walls 31 and 32 respectively. As partially shown in FIG. 7, knock-out flaps 39 and 40 are spaced in relation to interlock flaps 37 and 38 so that the interlock flaps 37 and 38 of the lower positioned carton overlie knock-out flaps 39 and 40, respectively, of the upper positioned carton apparatus when carton apparata are stacked upon one another.

The locking panel fold edges 59 through 62 separating locking flap member 33 and 34 from their respective third and fourth side walls 31 and 32 are substantially discontinuous about an offset region 81 and 82 respectively, therealong so as to form alignment flap means 63 and 64, which, upon articulation of the carton apparatus, extend above their associated third and fourth side walls 31 and 32. Additionally, third and fourth side wall fold edges 67 and 68 are substantially discontinuous about locking means retention notches 69 and 70, respectively, therealong so as to form locking receptacles upon articulation of the third and fourth side walls 31 and 32 with respect to bottom panel 16.

Formed at the outer most edges of locking flap members 33 and 34 are locking tabs 83 and 84. Upon juxtaposition of locking flap members, 33 and 34 against third and fourth side walls 31 and 32 locking tabs 83 and 84 are interposed into locking receptacles created by locking means retention means 69 and 70 so as to effectively retain said locking panels in juxtaposed position and further retain interposed therein corner tabs 27 through 30.

First corner flap portions 19 and 21 of corner panels 19A and 21A are shown containing vent holes 75 and 76 which are created by notches formed into the outer edge of 59 and 60 such that fold plane region 77 is created therebetween. The use of two parallel locking panel fold lines 59 and 60 serves to facilitate interposition of corner tabs 27 and 30 into the space formed between and upon the juxtaposition of locking flap member 33 to third side wall 31. Similarly locking flap member 34 is shown connected to fourth side wall 32 along two similar parallel locking panel fold lines 61 and 62 which serves to create fold plate region 78 therebetween to likewise facilitate interposition of corner tabs 28 and 29 into the space created between and upon the juxtaposition of locking flap member 34 to fourth side wall 32. Notches 35 and 36 are shown formed into locking flap members 33 and 34, respectively, which serve to permit deflection of knock-out flaps 39 and 40 into the interior of the apparatus 15 when locking flap members 33 and 34 are in their juxtaposed position.

Deflectable knock-out flaps 39 and 40 are shown pre-formed into third and fourth side walls 31 and 32 respectively. Deflectable knock-out flaps 39 and 40 are shown comprising substantially rectangular members which are capable of being displaced to create an aperture. Knock-out flaps 39 and 40 are formed by incisions 71 and 72 each extending about three sides of the respective rectangular members where the fourth side of each comprises perforations 73 and 74 which serve to retain knock-out flaps 39 and 40 in place until such time as they are manually displaced as further described hereinbelow.

Deflectable interlock flaps 37 and 38 are shown preformed into side walls 31 and 32 respectively. Deflectable interlock flaps 37 and 38 are shown comprising substantially trapezoidal members which are capable of being deflected and interposed into the apertures created upon the deflection of like knock-out flaps 39 and 40 of an above placed like carton apparatus. Interlock flaps 37 and 38 are said first corner flap portions 19 and 21.

Figure 2:
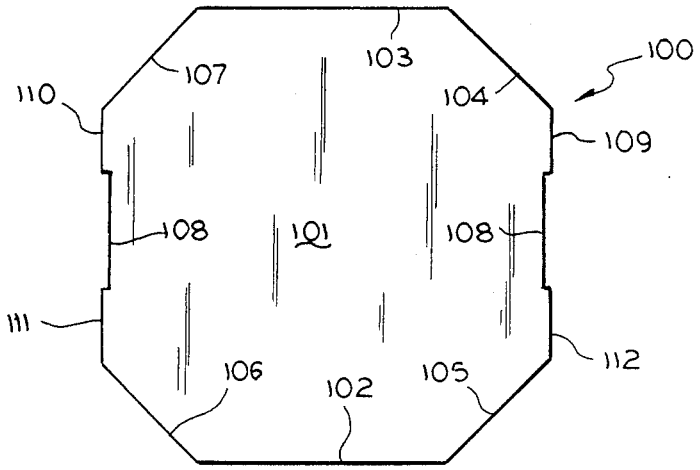
FIG. 2 of the drawings is a top plan view of the detached cover panel for the present carton apparatus.

FIG. 2 illustrates cover panel 100. Cover panel 100 is, in one embodiment, octagonal in shape as described by member 101 having edges 102 through 112. In the embodiment illustrated edges 104 through 107 serve to overlap corner panels 19A through 22A and edges 102 and 103 serve to overlap first and second side walls 17 and 18 when cover 100 is disposed upon the open end of carton apparatus 15. In the preferred embodiment of the invention, cover panel 100 is slightly larger in dimension than bottom panel 16 so as to completely cover the opening created upon articulation of carton apparatus 15. Notches 108 are formed into the opposing edges of cover panel 100 about the edges 109 through 112 which overlie the third and fourth side walls 31 and 32. Notches 108 of cover panel 100 may then be aligned with projecting panel members 63 and 64 when cover panel 100 is placed upon carton apparatus 15, whereby the combination of friction and the taper imparted to projecting panel members 63 and 64 retain cover panel 100 in place.

Figure 3:
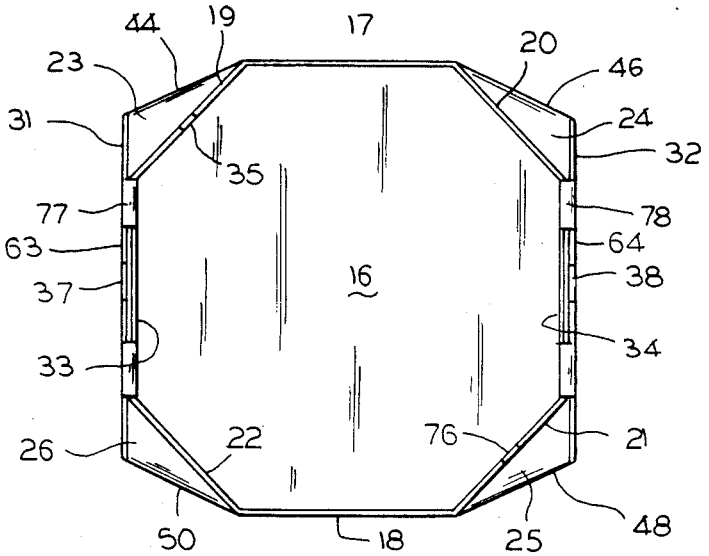
FIG. 3 of the drawings is a top plan view of the articulated container tray blank for the present carton apparatus illustrating the bottom panel, side walls, articulated corner panels and locking panels.

FIG. 3 is a top plan view of the articulated carton apparatus 15 wherein the octagonal shape of that particular container is illustrated. First and second side walls 17 and 18, and third and fourth side walls 31 and 32, are shown articulated into their upright opposing position. Corner panels 19A through 22A are articulated about their respective corner flap fold lines 43, 45, 47 and 49 and second corner flap portion fold edges 44, 46, 48 and 50. Second corner flap portions 23 through 26 of corner panels 19A through 22A are shown folded onto bottom panel 16 upon articulation of the carton apparatus 15 thus forming four substantially diagonal corner walls. Locking flap members 33 and 34 are shown juxtaposed against third and fourth side walls 31 and 32. Alignment flap means 63 and 64 are visible as are deflectable knock-out tabs 37 and 38 pre-formed therein. Opposing vent holes 75 and 76 are shown positioned in first corner flap portions 19 and 21 of corner panels 19A and 21A.

Figure 4:
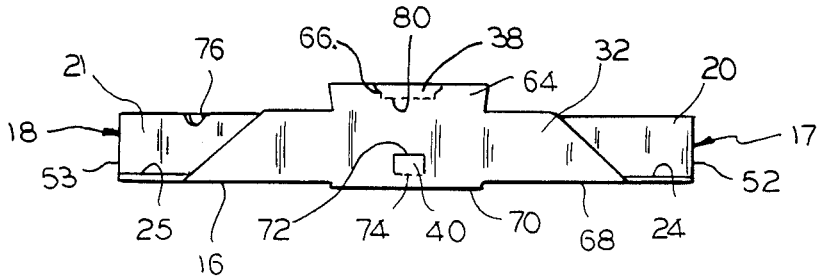
FIG. 4 of the drawings is a side elevational view of the carton apparatus illustrating the stacking and locking means for aligning and releasably joining multiple carton apparata and specifically the projecting panel member, and knock-out panel and knock-out tab formed into the third side wall.

FIG. 4 is a side elevational view of the apparatus taken viewing fourth side wall 32. Deflectable interlock flap 38 is shown formed into alignment flap means 64 prior to being manually deflected. Likewise, deflectable knockout flap 40 is shown pre-formed into fourth side wall 32. Upon articulation of the carton apparatus 15 and juxtaposition of locking flap member 34 against fourth side wall 32, it can be seen that alignment flap means 64 extends above its associated side wall 32. Likewise, upon articulation of side wall 32 with respect to bottom panel 16, locking means retention notch 70 is formed which extends slightly below the lower surface of bottom panel 16. Vent hole 76 shown formed into first corner flap portion 21 of corner panel 21. Additionally, second corner flap portions 24 and 25 of corner panels 20A and 21A are shown folded upon bottom panel 16 upon articulation of the carton apparatus 15.

Figure 5:
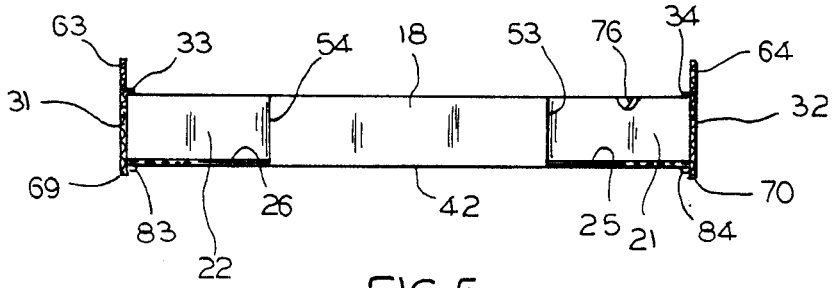
FIG. 5 of the drawings is a side elevational view of the carton apparatus illustrating stacking and locking means for aligning and releasably joining multiple carton tray members.

FIG. 5 a side elevational view of the apparatus taken viewing second side wall 18. Alignment flap means 63 and 64 are shown extending above the associated third and fourth side walls 31 and 32. Locking tabs 83 and 84 associated with locking flap members 33 and 34 are shown interposed into and extending through receptacles created by locking means retention notches 69 and 70 after articulation of the carton apparatus 15. Corner tabs 29 and 30 associated with first corner flap portions 21 and 22 of corner panels 21A and 22A are thus interposed beneath and held in place by locking flap members 33 and 34.

Figure 6:
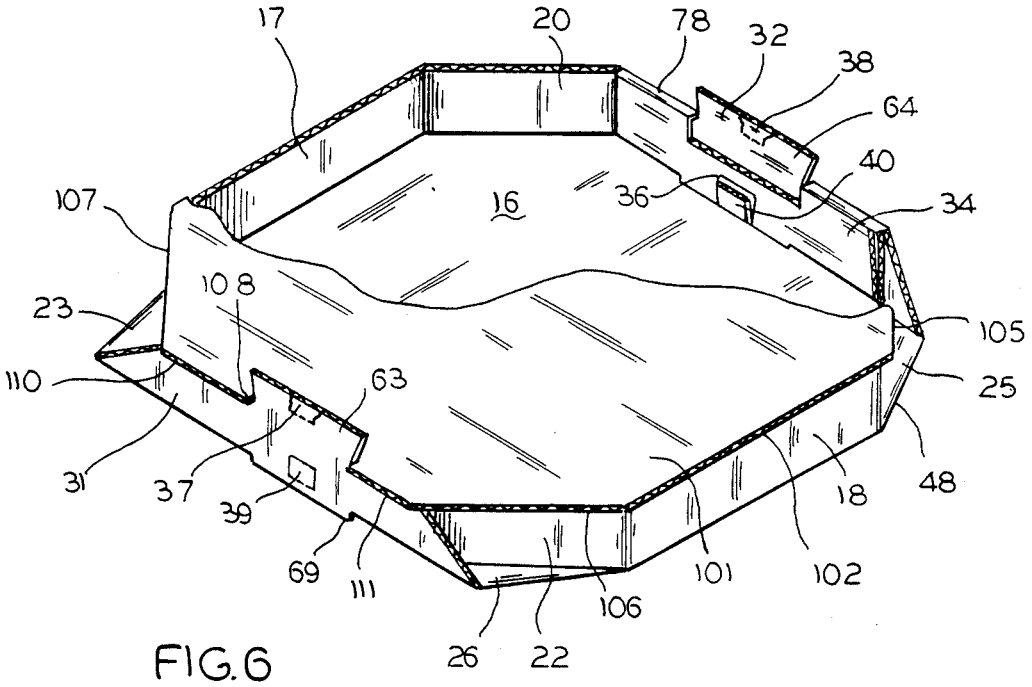
FIG. 6 of the drawings is a perspective view of a single carton tray member having a cover panel placed thereon, specifically illustrating an inner perspective view of the locking panel juxtaposed to the fourth side wall and projecting panel member extending thereabove.

FIG. 6 illustrates an articulated carton apparatus 15 having placed thereon cover panel 100 where cover panel 100 is shown broken away to reveal the interior of apparatus 15. Alignment flap means 63 is shown engaged with notch 108 which, due to the taper of alignment flap means 63, is effectively retained in place by friction thereby sealing carton apparatus 15. Locking flap member 34 is shown articulated and juxtaposed against side wall 32. Notch 36 is shown formed into locking flap member 34 so as to permit knock-out flap 40 to be displaced by interlock flap 38 as shown. Locking tab 84 is interposed into the receptacle created by retention notch 70. Cover panel 100 is further shown having an overall dimension slightly greater than that of bottom panel 16 so as to effectively overlap and seal the open cavity when cover panel 100 is placed upon carton apparatus 15.

Figure 7:
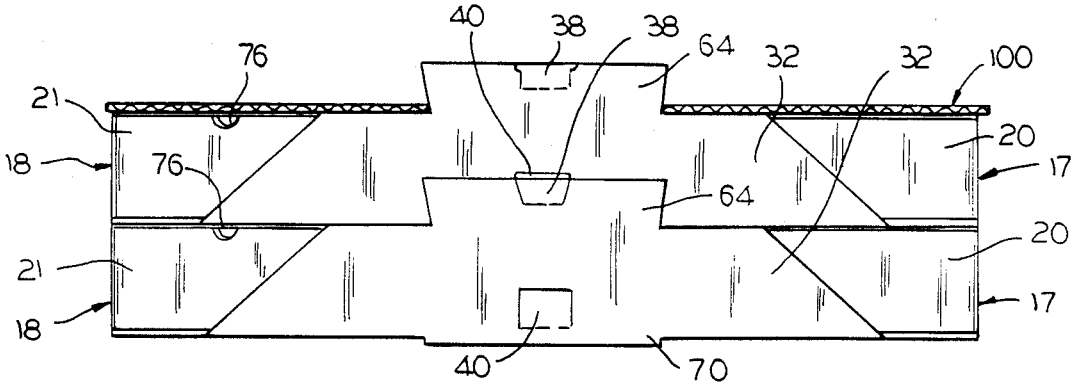
FIG. 7 of the drawings is a side elevational view of the carton tray apparatus illustrating the stacking of two carton apparata, with the uppermost carton tray member having a cover panel placed thereon, and with the bottom panel of the upper carton apparata serving as the cover panel for the lower carton tray member.

FIG. 7 illustrates a preferred embodiment of the invention wherein multiple carton apparata are stacked upon one another such that the bottom panel 16 of the upper carton apparatus serves to provide the cover for the lower carton apparatus. Accordingly, in the embodiment illustrated, two containers are provided requiring only a single detachable cover panel 100. Likewise the first, second and third side walls of the upper and lower apparata are shown in alignment with one another. Fourth side wall 32 of the upper container apparatus is shown in alignment with the fourth side wall 32 of the lower carton apparatus. Alignment flap means 64 of the lower container apparatus is shown juxtaposed against the fourth side wall 32 of the upper container apparatus when the two are stacked. Alignment flap means 64 thus serves to maintain the alignment of stacked assembly of carton apparata.

Deflectable interlock flap 38 of the lower carton apparatus is shown as being in alignment with the deflectable knock-out flap 40 of the upper carton apparatus when the two carton apparata are stacked upon one another. As illustrated, both knock-out flap 40 and interlock flap 38 are deflected from their normal positions such that interlock flap 38 is interposed into the aperture created upon the deflection of knock-out flap 40. In utilization of the present arrangement, deflectable knock-out flap 40 of the lower-most container apparatus is not deflected and thereby preserves the substantially continuous side wall configuration 32. Cover 100 is disposed upon the upper-most carton apparatus thereby serving to seal the cavity created thereunder, retain the warmth of the pizza food product held therein, as well as permit additional assemblies of separately stacked carton apparata, or other objects, to be placed thereupon without crushing the underlying stacked assembly and food products contained therein. Likewise, interlock flap 38 of the uppermost carton apparatus may be deflected to assist in further retaining cover 100 in place.

Figure 8:
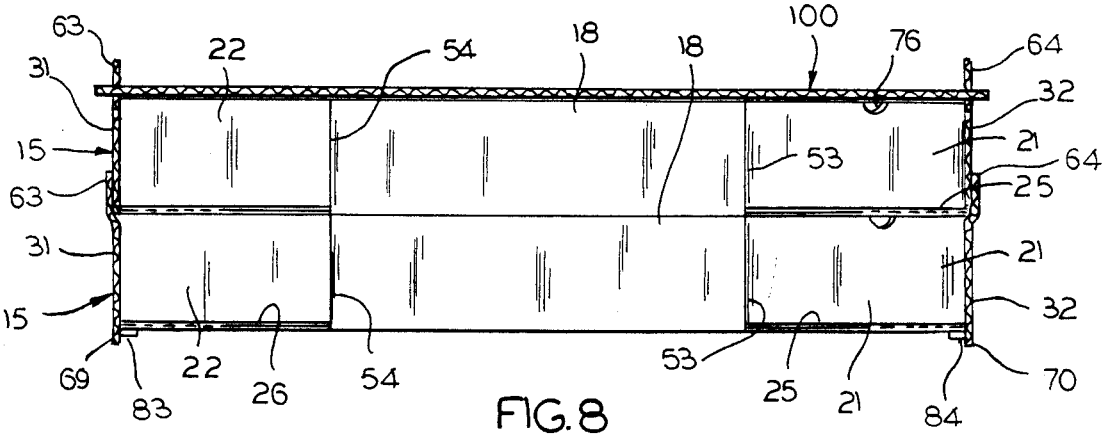
FIG. 8 of the drawings is a side elevational view of the carton tray members of FIG. 7 illustrating the stacking of two carton apparata with the upper carton apparatus having a cover panel placed thereon.

FIG. 8 is a side elevational view of the second side wall 18 of the stacked carton apparata assembly of FIG. 7. Alignment flap means 63 and 64 of the lower-most carton apparatus are shown juxtaposed to third and fourth side walls 31 and 32 respectively of the upper-most carton apparatus. As likewise shown in FIG. 7, the bottom panel member 16 of the upper-most carton apparatus serves to form the cover panel for the lower carton apparatus. Accordingly, only a single cover 100 is needed for the entire stacked assembly.

Figure 9:
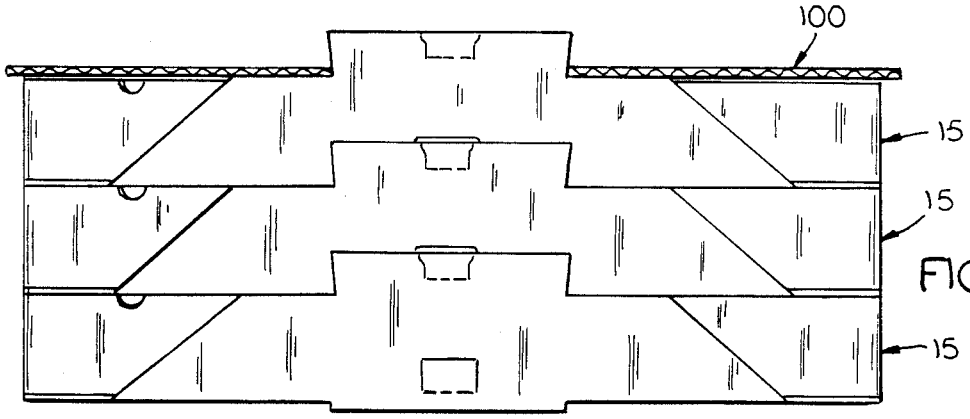
FIG. 9 of the drawings is a side elevational view of the carton tray apparatus illustrating the stacking of three carton apparata with the uppermost carton apparatus having a cover panel placed thereon and with the bottom panel of the uppermost and middle positioned carton apparata serving as the cover panels for the middle and lowermost carton tray apparata, respectively.

FIG. 9 illustrates the stacking of three carton apparata upon one another whereby three pizzas may be packaged in effectively separate wrappers. As shown, the bottom panel 16 of the middle carton apparatus serves to provide the cover for the lower carton apparatus, while the bottom panel 16 of the upper-most carton apparatus serves to provide the cover for the middle carton apparatus. Accordingly, in this particular arrangement, it is possible to dispense with two cover panels inasmuch as only a single cover panel 100 is required to cover the upper-most carton apparatus, thereby saving a substantial quantity of paperboard.

Figure 10:
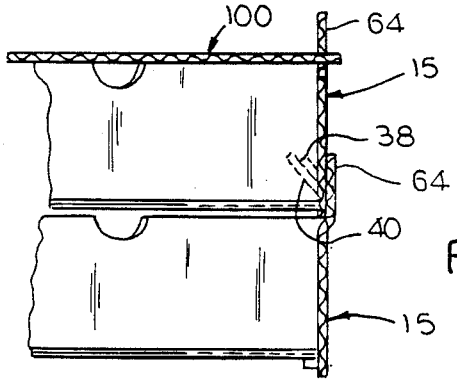
FIG. 10 of the drawings is a side cross sectional view of the carton apparatus illustrating the stacking of two carton apparata with the uppermost carton apparatus have a cover panel placed thereon, and specifically showing the interposition of the interlocking member of the lower carton apparatus prompted into the displaced knock-out panel aperture of the uppermost carton apparatus.

FIG. 10 of the drawings illustrates the cooperation of interlock flap 38 and knock-out flap 40 wherein each are deflected from their normal position such that interlock flap 38 is interposed into the aperture created by the deflection of knock-out flap 40. Due to the tapered end of interlock flaps 37 and 38, the stacked arrangement of multiple carton apparata are effectively retained in a stacked orientation and thus precluded from shifting apart due to the inability of the tapered portion of interlock flap 38 to easily and unintentionally dislodged from the aperture formed knock-out flap 40. As such, the cooperation of interlock flap 39 and knock-out flap 40 substantially retain the multiple carton apparata in a stacked configuration.

The foregoing description and drawings merely explain and illustrate the invention and the invention is not limited thereto, except insofar as the appended claims are so limited as to those skilled in the art have the disclosure before them will be able to make modifications and variations therein without departing from the scope of the invention.

What is claimed is:

1. A stackable articulated carton tray apparatus for flat food products, particularly pizza pies, which apparatus is capable of being stacked in successively adjacent multiple quantities upon one another such that a bottom panel of an upper carton apparatus forms a cover for an adjacent lower carton apparatus, and joinable in a manner so as to prevent the shifting and separation of the stacked carton apparatuses during transport, to thereby enable the packaging of multiple pizza pies without the additional material, expense and labor incurred in providing each pizza pie with its own complete container, said apparatus comprising:

bottom panel means for forming a bottom to each said carton tray apparatus;

a first pair of upstanding opposite first and second side wall means operably attached to and emanating upwardly from said bottom panel means for forming at least two of the side walls of said carton tray apparatus;

a second pair of upstanding opposite third and fourth side wall means operably attached to and emanating upwardly from said bottom panel means for forming at least two of the side walls of said carton tray apparatus;

tray locking means operably positioned on one or more of said respective upstanding first, second, third and fourth side wall means emanating upwardly from said bottom panel means, for maintaining said first, second, third and fourth side wall in a restrained articulated shape;

a plurality of corner panel means attached at opposite ends of one or more of said first and second pairs of side wall means and further attached to an adjacent edge of said bottom panel means for forming substantially diagonal corner wall means upon articulation of said carton apparatus;

corner tab means operably attached to said plurality of corner panel means along substantially continuous corner tab fold edges therebetween, said corner tab means being restrainably interposed between adjacent respective ones of said one or more first, second, third and fourth side wall means upon the articulation of said carton apparatus, by said tray locking means, toward formation and maintenance of a substantially rigid articulated tray member;

stacking means emanating from one or more of said first, second, third and fourth side wall means for aligning and releasably joining multiple like ones of said carton tray apparatuses in stacked configuration; and detachable cover panel means operably positionable upon the uppermost one of a plurality of said like tray members, as a top closure to the food product positioned within said uppermost tray member.

2. The invention according to claim 1 in which said plurality of corner panel means are operably attached at opposite ends of said first and second side wall means so as to emanate therefrom, said corner tab means of said respective corner panel means being restrainably interposed between respective adjacent ones of said third and fourth side wall means and said corner panel means.

3. The invention according to claim 2 in which said tray locking means are operably positioned on each of said third and fourth side wall means.

4. The invention according to claim 1 wherein said upstanding opposite first and second side wall means are operably attached for articulation to said bottom panel means along substantially continuous respective first and second side wall fold edges therebetween;

said upstanding opposite third and fourth side wall means being operably attached for articulation to said bottom panel means along respective third and fourth side wall fold edges therebetween; and said tray locking means comprising a locking flap member operably attached for articulation to said respective upstanding opposite third and fourth side wall means, along respective locking panel fold edges therebetween, for enveloping and restraining respective ones of adjacent interposed corner tab means and for in turn maintaining said first, second, third and fourth side wall means in positions substantially normal to said bottom panel means.

5. The invention according to claim 4 wherein said locking panel fold edges are substantially discontinuous about an offset region therealong so as to form said stacking means upon articulation of said carton apparatus;

said stacking means extending above said associated third and fourth side wall means respectively so as to abut and be juxtaposed to the third and fourth side wall means of a superimposed like tray member, for the alignment and releasable joining of successive ones of said like tray members stacked thereupon abovemost one of said tray members.

6. The invention according to claim 5 in which said stacking means further includes;

interlock means operably positioned in said stacking means for releasably attaching a portion of said stacking means to a portion of said superimposed like tray member;

said interlock means comprising an interlock flap member in said stacking means together with knock-out flap means in said superimposed like tray member, for the aligned telescopic receipt of said interlock flap member within an aperture formed by said knock-out flap means to further prevent separation of stacked carton apparata from one another.

7. The invention according to claim 6 wherein said knock-out flap means are pre-formed into said third and fourth side wall means in said superimposed like tray member, and comprise substantially rectangular flap members capable of being displaced to create said aperture for accepting the receipt and interposition of said interlock flap member from the tray member positioned immediately below said superimposed like tray member.

8. The invention according to claim 1 wherein said plurality of corner panel means are attached to one or more of said first, second, third and fourth side wall means along a plurality of corner panel fold lines respectively, each said corner fold line being scored with a plurality of perforations positioned along same.

9. The invention according to claim 1 wherein said tray locking means emanate from respective ones of said side wall means along locking means fold edges operably positioned between said tray locking means and said respective side wall means;

each said locking means fold edges comprising two substantially parallel fold lines to create a fold plane member, each of which include a plurality of perforations formed therewithin, said two fold lines and fold plane member facilitating the envelopment, interpositioning and retention of said respective ones of said corner tab means by respective ones of said tray locking means in cooperation with the respective side wall means from which the tray locking means emanates.

10. The invention according to claim 1 wherein said detachable cover panel means is substantially octagonal in shape and of an overall dimension capable of covering all of the upward facing edges of said first, second, third and fourth side wall means, and said substantially diagonal corner wall means, to in turn, fully cover said food product within said uppermost tray member.

11. The invention according to claim 10 wherein two opposing edges of said detachable cover means include notches for receiving said stacking means from said uppermost like tray member so as to releasably secure said cover panel means in place upon said uppermost like tray member.

12. The invention according to claim 11 in which said stacking means in said uppermost like tray member further includes interlock means operably positioned therewithin for releasably engaging and maintaining said detachable cover panel means in place atop said uppermost like tray member.

13. The invention according to claim 1 in which said tray locking means are operably positioned on each of said third and fourth side wall means;

said third and fourth side wall means emanating respectively along third and fourth side wall fold edges which are substantially discontinuous about an offset region therealong said respective third and fourth side wall means so as to form locking means retention notches therein said third and fourth side wall fold edges upon articulation of said third and fourth side wall means;

said tray locking means on each of said third and fourth side wall means including locking tab means which, upon articulation of said carton apparatus, are interposed into and restrainably received by respective ones of said locking means retention notches towards retaining said tray locking means in a position in which respective ones of said corner tab means are operably enveloped, interposed and maintained within respective ones of said third and fourth side wall means and associated tray locking means, thereby forming said erect tray member.

14. The invention according to claim 1 wherein at least one of said plurality of corner panel means includes a vent hole for venting from the interior of said carton apparatus moist air generated by heated food products towards retaining the crispness of said food product.

15. The invention according to claim 1 wherein said first second, third and fourth side wall means emanate from said bottom panel means along first, second, third and fourth side wall fold edges respectively;

said tray locking means emanating from one or more of said first, second, third and fourth side wall means along locking panel fold edges respectively;

said first, second, third and fourth side wall fold edges, said locking panel fold edges, and said corner tab fold edges each including a plurality of perforations formed and scored therewithin.

16. The invention according to claim 1 in which said bottom panel means, said first and second side wall means, said third and fourth side wall means, said tray locking means, said plurality of corner panel means, and said corner tab means are all formed from a single substantially continuous sheet of apparatus material.

17. The invention according to claim 16 wherein said apparatus material comprises a corrugated cardboard material.

18. A stackable articulated carton tray apparatus for flat food products, particularly pizza pies, which apparatus is capable of being stacked in successively adjacent multiple quantities upon one another such that a bottom panel of an upper carton apparatus forms a cover for an adjacent lower carton apparatus, and joinable in a manner so as to prevent the shifting and separation of the stacked carton apparatuses during transport, to thereby enable the packaging of multiple pizza pies without the additional material, expense and labor incurred in providing each pizza pie with its own complete container, said apparatus comprising:

bottom panel means for forming a bottom to each said carton tray apparatus;

a first pair of upstanding opposite first and second side wall means operably attached to and emanating upwardly from said bottom panel means for forming at least two of the side walls of said carton tray apparatus;

a second pair of upstanding opposite third and fourth side wall means operably attached to and emanating upwardly from said bottom panel means for forming at least two of the side walls of of said carton tray apparatus;

tray locking means operably positioned on one or more of said respective upstanding first, second, third and fourth side wall means emanating upwardly from said bottom panel means, for maintaining said first, second, third and fourth side walls in a restrained articulated shape;

a plurality of corner panel means attached at opposite ends of one or more of said first and second pairs of side wall means, for forming substantially diagonal corner wall means upon articulation of said carton apparatus, each of said plurality of corner panel means further including a first corner flap portion and a second corner flap portion, each of said first corner flap portions being operably attached at opposite ends of each of said first and second side wall means for deployment in an upwardly emanating position substantially normal to said bottom panel means, upon articulation of said carton tray apparatus, each of said second corner flap portions being operably attached at a first side to a respective one of said first corner flap portions and attached at a second side, to an adjacent edge of said bottom panel means, for overlying juxtaposition to said bottom panel means upon articulation of said carton apparatus, as well as prompting of each of said first corner flap portions into substantially diagonal corner wall elements upon articulation of said carton tray apparatus, corner tab means operably attached to said plurality of corner panel means along substantially continuous corner tab fold edges therebetween, said corner tab means being restrainably interposed between adjacent respective ones of said one or more first, second, third and fourth side wall means upon the articulation of said carton apparatus, by said tray locking means, towards formation and maintenance of a substantially rigid articulated tray member;

stacking means emanating from one or more of said first, second, third and fourth side wall means for aligning and releasably joining multiple like ones of said carton tray apparatuses in stacked configuration; and detachable cover panel means operably positionable upon the uppermost one of a plurality of said like tray members, as a top closure to the food product positioned within said uppermost tray member.

19. The invention according to claim 18 wherein each of said first corner flap portions of said corner panel means are connected to each of said respective second corner flap portions of said corner panel means, respectively, at a corner flap fold line for rotation therebetween upon articulation of said carton tray apparatus.

20. A stackable articulated carton tray apparatus for flat food products, particularly pizza pies, which apparatus is capable of being stacked in successively adjacent multiple quantities upon one another such that a bottom panel of an upper carton apparatus forms a cover for an adjacent lower carton apparatus, and joinable in a manner so as to prevent the shifting and separation of the stacked carton apparatuses during transport, to thereby enable the packaging of multiple pizza pies without the additional material, expense and labor incurred in providing each pizza pie with its own complete container, said apparatus comprising:

bottom panel means for forming a bottom to said carton tray apparatus;

a first pair of upstanding opposite first and second side wall means operably attached to and emanating upwardly from said bottom panel means for forming at least two of the side walls of said carton tray apparatus;

a second pair of upstanding opposite third and fourth side wall means operably attached to and emanating upwardly from said bottom panel means for forming at least two of the side walls of said carton tray apparatus;

tray locking means operably positioned on one or more of said respective upstanding first, second, third and fourth side wall means emanating upwardly from said bottom panel means, for maintaining said first, second, third and fourth side walls in a restrained articulated shape;

a plurality of corner panel means attached at opposite ends of one or more of said first and second pairs of side wall means, for forming substantially diagonal corner wall means upon articulation of said carton apparatus;

corner tab means operably attached to said plurality of corner panel means along substantially continuous corner tab fold edges therebetween, said corner tab means being restrainably interposed between adjacent respective ones of said one or more first, second, third and fourth side wall means upon the articulation of said carton apparatus, by said tray locking means, toward formation and maintenance of a substantially rigid articulated tray member;

stacking means emanating from one or more of said first, second, third and fourth side wall means for aligning and releasably joining multiple like ones of said carton tray apparatuses in stacked configuration;

said stacking means including one or more alignment flap means operably associated with one or more of said third and fourth side wall means, for telescopically receiving the bottom portion of a superimposed like tray member;

said stacking means further including interlock means operably positioned therewithin for releasably attaching a portion of said stacking means to said superimposed like tray member;

said interlock means comprising an interlock flap member in said stacking means together with knock-out flap means in said superimposed like tray member, for the aligned telescopic receipt of said interlock flap member within aperture formed by said knock-out flap means to further prevent separation of stacked carton apparata from one another; and detachable cover panel means operably positionable upon the uppermost one of a plurality of said like tray members, as a top closure to the food product positioned within said uppermost tray member.

* * * * *